US011689847B2

(12) United States Patent
Tisch et al.

(10) Patent No.: US 11,689,847 B2
(45) Date of Patent: Jun. 27, 2023

(54) WIND NOISE REDUCTION BY MICROPHONE PLACEMENT

(71) Applicant: GoPro, Inc., San Mateo, CA (US)

(72) Inventors: Erich Tisch, San Francisco, CA (US); Timothy Dick, San Francisco, CA (US); Eric Penrod, Brentwood, CA (US)

(73) Assignee: GoPro, Inc., San Mateo, CA (US)

( * ) Notice: Subject to any disclaimer, the term of this patent is extended or adjusted under 35 U.S.C. 154(b) by 0 days.

(21) Appl. No.: 17/587,064

(22) Filed: Jan. 28, 2022

(65) Prior Publication Data

US 2022/0150621 A1 May 12, 2022

Related U.S. Application Data

(63) Continuation of application No. 16/907,849, filed on Jun. 22, 2020, now Pat. No. 11,245,982.

(51) Int. Cl.
*H04R 1/40* (2006.01)
*H04S 1/00* (2006.01)
(Continued)

(52) U.S. Cl.
CPC ..... *H04R 1/406* (2013.01); *H04R 1/04* (2013.01); *H04R 3/005* (2013.01); *H04R 29/005* (2013.01);
(Continued)

(58) Field of Classification Search
CPC ..... H04R 1/406; H04R 1/04; H04R 3/005; H04R 29/005; H04R 2410/01;
(Continued)

(56) References Cited

U.S. PATENT DOCUMENTS 3,830,988 A 8/1974 Mol
9,807,530 B1 * 10/2017 Tisch ..... H04R 1/083
(Continued)

OTHER PUBLICATIONS

U.S. Appl. No. 16/372,611, filed Apr. 2, 2019, Inventor: Eric Penrod. 30 pages.
(Continued)

*Primary Examiner* — William A Jerez Lora
(74) *Attorney, Agent, or Firm* — Young Basile Hanlon & MacFarlane, P.C.

(57) ABSTRACT

An image capture device, having: a housing, a lens snout, a front microphone, a top microphone, and an audio processor. The housing has a top and front housing surface. The lens snout protrudes from the front housing surface. The front microphone mounted within or on the front housing surface and below the lens snout. The top microphone mounted within or on a top housing surface in a position biased toward the front housing surface. The audio processor comprises a memory that is configured to store instructions that when executed cause the audio processor to generate an output audio signal. The top microphone is located at a position to receive direct freestream air flow when the housing is positioned in a pitched forward orientation at a pitched forward angle relative to a vertical axis. The front microphone receives turbulent air flow from the lens snout when the housing is positioned in the pitched forward orientation.

20 Claims, 9 Drawing Sheets

(51) Int. Cl.
*H04R 3/00* (2006.01)
*H04R 1/04* (2006.01)
*H04R 29/00* (2006.01)

(52) U.S. Cl.
CPC ..... *H04S 1/007* (2013.01); *H04R 2410/01* (2013.01); *H04R 2410/07* (2013.01); *H04R 2430/03* (2013.01); *H04R 2499/11* (2013.01); *H04S 2400/15* (2013.01)

(58) Field of Classification Search
CPC ..... H04R 2410/07; H04R 2430/03; H04R 2499/11; H04S 1/007; H04S 2400/01
USPC ..... 381/71.14, 91, 94.2, 94.3, 320
See application file for complete search history.

(56) References Cited

U.S. PATENT DOCUMENTS

| | | | | |
|---|---|---|---|---|
| 11,245,982 | B2 | 2/2022 | Tisch | |
| 2005/0140810 | A1* | 6/2005 | Ozawa | H04N 23/631 348/333.02 |
| 2018/0084339 | A1* | 3/2018 | Asuncion | H04R 1/44 |
| 2021/0400380 | A1 | 12/2021 | Tisch | |

OTHER PUBLICATIONS

U.S. Appl. No. 62/900,936, filed Sep. 16, 2019, Inventor: Erich Tisch. 47 pages.
U.S. Appl. No. 62/901,505, filed Sep. 17, 2019, Inventor: Erich Tisch. 46 pages.

* cited by examiner

WIND NOISE REDUCTION BY MICROPHONE PLACEMENT

CROSS-REFERENCE TO RELATED APPLICATION(S)

This application is a continuation of and claims priority to U.S. application Ser. No. 16/907,849, filed on Jun. 22, 2020, the entire disclosure of which is hereby incorporated by reference.

TECHNICAL FIELD

This disclosure relates generally to an audio system for an image capture device. More specifically, this disclosure relates to a microphone placement arrangement that provides wind noise reduction to accommodate turbulence caused by protruding features.

BACKGROUND

Photography during physical activity has been improved by use of simple-to-operate, lightweight, compact cameras. These cameras can be used in a variety of environments, including environments where the camera will be exposed to water such as beaches, lakes, pools, oceans, etc. Optimizing audio capture may be challenging when the conditions are subject to frequent changes, such as when the camera is moved in and out of the presence of wind. Protruding features on the camera, such as lens covers, can also pose challenges when they are positioned near a microphone mounted within the body. Techniques for addressing wind noise may encounter challenges when turbulence generated by the protruding features affect the performance of microphones mounted nearby.

SUMMARY

Disclosed herein are implementations of a microphone drainage system for an image capture device.

In one embodiment, an image capture device includes a housing having a top housing surface, a front housing surface, and two side housing surfaces. The image capture device includes a lens snout protruding from the front housing surface. A front microphone is mounted within the housing behind the front housing surface below the lens snout to capture audio waves. A top microphone is mounted within the housing under the top housing surface housing to capture audio waves. An audio processor within the housing utilizes memory storing instructions to receive a first audio signal from the front microphone and a second audio signal from the top microphone. The audio processor generates first frequency sub-band signals from the first audio signal and second frequency sub-band signals from the second audio signal. The audio processor for each frequency sub-band selects from the first frequency sub-band signals and second frequency sub-band signals the sub-band signals with the lowest noise metric. The audio processor then combines the selected sub-band signals to generate an output audio signal. This allows the effect of wind-noise to be minimized by selecting the sub-band signals with the least wind-noise and combining them into an improved output audio signal. The top microphone is positioned to receive direct freestream air flow when the housing is positioned in a pitched forward orientation at a first pitched forward angle relative to a vertical axis. The front microphone is positioned to receive turbulent air from the lens snout when the housing is positioned in a pitched forward orientation at a second pitched forward angle relative to the vertical axis.

In one embodiment, an image capture device includes a housing a housing having a first, second, and third housing surfaces that are orthogonal to each other. A first microphone is positioned within the first housing surface adjacent a protruding feature (such as a lens snout). A second microphone is positioned within the second housing surface. An audio processor receives audio signals from the first and second microphone and generates sub-band signals for each. The audio processor then selects the sub-band signals for each frequency sub-band that have the lowest noise metric. The audio processor then combines the selected sub-band signals to generate an output audio signal. The first microphone is positioned on the first housing surface to receive direct freestream air flow when the housing is positioned in a pitched orientation with a first pitched angle. The second microphone is positioned on the second housing surface such that it receives turbulent air flow from the protruding feature when the housing is positioned in the pitched orientation at a second pitched angle. By making the second pitched angle equal to or greater than the first forward angle, the microphone positioning ensures that as one or more of the sub-band signals from the second microphone increase in noise metric that one or more of the sub-band signals from the first microphone are lowering in noise metric. This allows an improvement in the output audio signal.

In one embodiment, a method of reducing wind noise in an image capture device includes receiving, by an audio processor, a first audio signal from a first microphone mounted above a protruding feature extending from a first housing surface of the image capture device. The first microphone is mounted to receive free stream air flow when the housing is positioned in a pitched forward orientation at a first pitched forward angle. The method includes receiving, by the audio processor, a second audio signal from a second microphone mounted below the protruding feature. The second microphone is mounted to receive turbulent air flow when the housing is positioned in the pitched forward orientation at a second pitched forward angle. The second pitched forward angle is greater than or equal to the first pitched forward angle. The method generates, using the audio processor, first and second frequency sub-band signals from the first audio signal and the second audio signal, respectively. The method selects, using the audio processor, from the first and second frequency sub-band signals having the lowest noise metric. The method then combines the selected sub-band signals, using the audio processor, to generate an output audio signal.

In one embodiment, an image capture device, has: a housing, a lens snout, a front microphone, a top microphone, and an audio processor. The housing has a top and front housing surface. The lens snout protrudes from the front housing surface. The front microphone mounted within or on the front housing surface and below the lens snout. The top microphone mounted within or on a top housing surface in a position biased toward the front housing surface. The audio processor comprises a memory that is configured to store instructions that when executed cause the audio processor to generate an output audio signal. The top microphone is located at a position to receive direct freestream air flow when the housing is positioned in a pitched forward orientation at a pitched forward angle relative to a vertical axis. The front microphone receives turbulent air flow from the lens snout when the housing is positioned in the pitched forward orientation.

In one embodiment, an image capture device, has a housing, a protruding feature, a first microphone, a second microphone, and an audio processor. The housing has a first housing surface and a second housing surface orthogonal to the first housing surface. The protruding feature protruding from the first housing surface. The first microphone mounted within or on the first housing surface and adjacent to the protruding feature. The second microphone mounted within or on the second housing surface. The audio processor comprising a memory configured to store instructions that when executed cause the audio processor to generate an output audio signal. The first microphone is located at a position under or on the first housing surface to receive direct freestream air flow when the housing is positioned in a pitched orientation with a first pitched angle and in a position where the first microphone does not receive direct freestream air flow while the housing is in a vertical orientation. The turbulent air flow from the protruding feature contacts the second microphone when the housing is positioned in the pitched orientation. In one embodiment, a method that receive a first audio signal, receive a second audio signal, generate a frequency sub-band, select a frequency sub band, and combine a elected sub-band. Receiving, by an audio processor, a first audio signal from a first microphone mounted above a protruding feature extending from a first housing surface of a housing of an image capture device, the first microphone mounted to receive direct freestream air flow when the housing is positioned in a pitched forward orientation at a first pitched forward angle. Receiving, by the audio processor, a second audio signal from a second microphone mounted below the protruding feature, wherein the second microphone in the pitched forward orientation receives turbulent air flow. Generating, by the audio processor, for frequency sub-bands, first frequency sub-band signals from the first audio signal. Generating, by the audio processor, for the frequency sub-bands, second frequency sub-band signals from the second audio signal. Selecting, by the audio processor, for respective frequency sub-bands, one of the first frequency sub-band signals or the second frequency sub-band signals having a lowest noise metric. Combining, by the audio processor, the selected sub-band signals to generate an output audio signal.

Additional embodiments are described in further detail below.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Performance of a multi-microphone arrangement within an image capture device can be dependent on the positioning an arrangement of the microphones relative to incoming audio sound waves as well as the changing environmental factors that action and sports devices may encounter during operation. For example, an image capture device may be utilized in environments where the environmental wind or movement of the device may introduce wind noise. Mounting of the image capture device on helmets, cars, bikes, snowboards, etc. may dictate that the desired angle of view for the video capture may vary from a traditionally upright position. While these angled positions may provide desirable directions of view of the action, they may also introduce challenges to the audio capture elements of the image capture device. The introduction of protruding elements or surfaces on the image capture device may result in turbulence that can impact audio capture performance. A strategic placement of multiple audio capture elements in locations on the image capture device can mitigate the impact of turbulent flow on one or more of the audio capture elements.

Figure 1A:
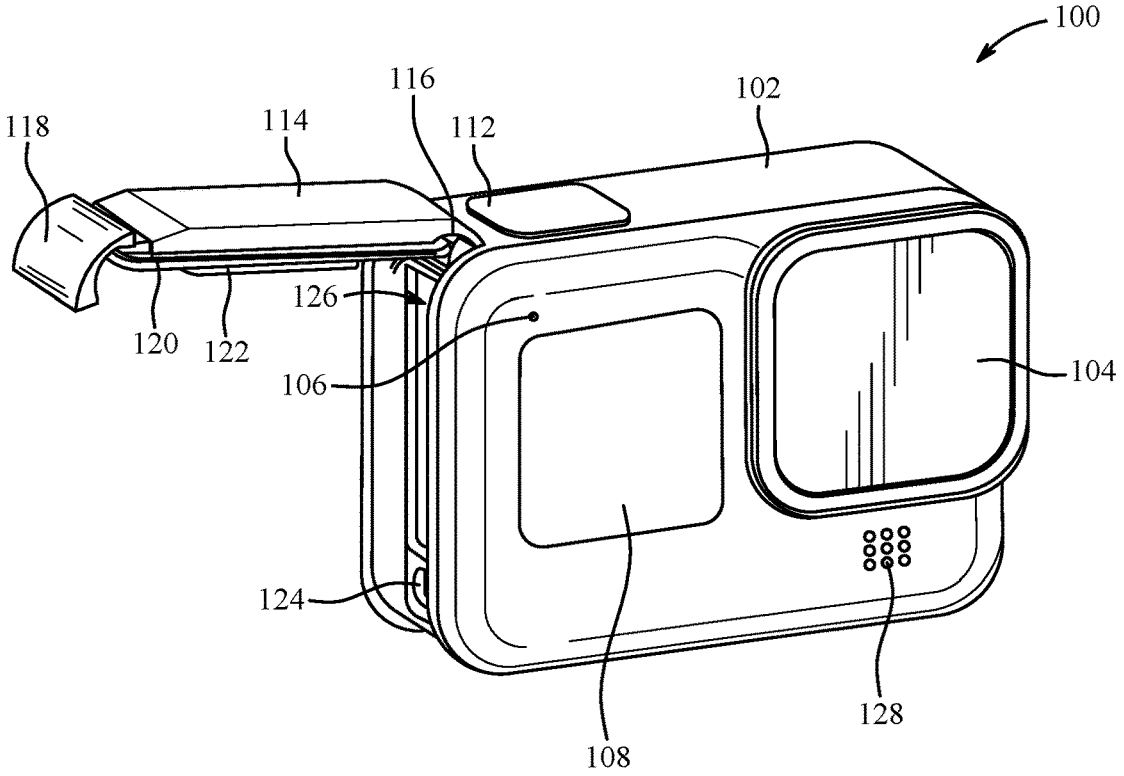
FIGS. 1A-B are isometric views of an example of an image capture device.
Figure 1B:
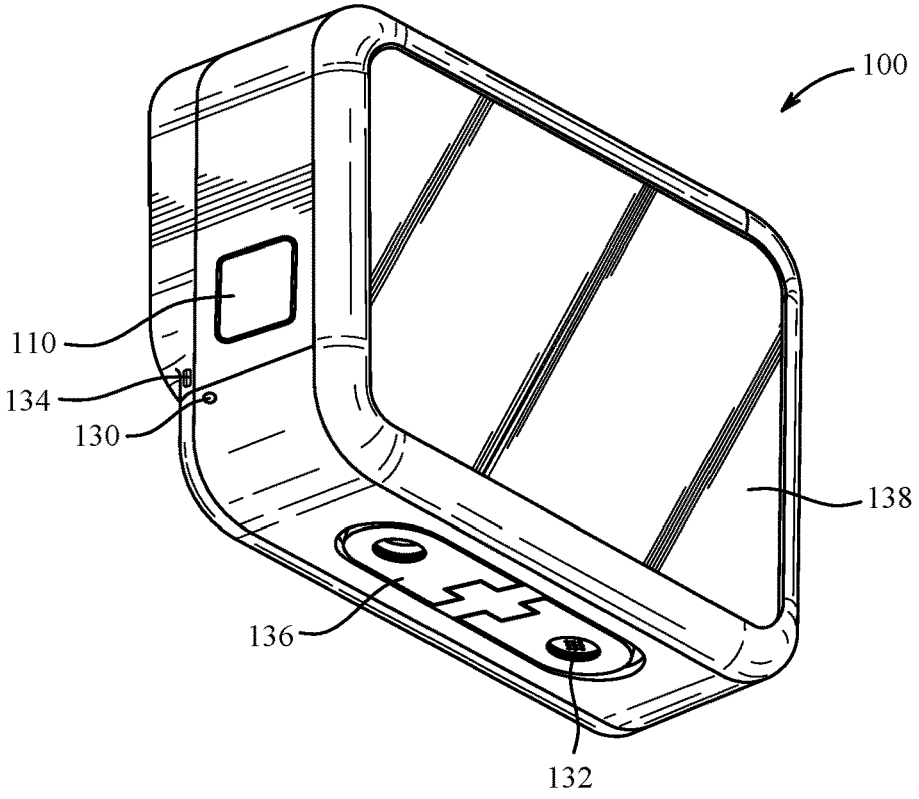

FIGS. 1A-B are isometric views of an example of an image capture device 100. The image capture device 100 may include a body 102, a lens 104 structured on a front surface of the body 102, various indicators on the front surface of the body 102 (such as light-emitting diodes (LEDs), displays, and the like), various input mechanisms (such as buttons, switches, and/or touch-screens), and electronics (such as imaging electronics, power electronics, etc.) internal to the body 102 for capturing images via the lens 104 and/or performing other functions. The lens 104 is configured to receive light incident upon the lens 104 and to direct received light onto an image sensor internal to the body 102. The image capture device 100 may be configured to capture images and video and to store captured images and video for subsequent display or playback.

The image capture device 100 may include an LED or another form of indicator 106 to indicate a status of the image capture device 100 and a liquid-crystal display (LCD) or other form of a display 108 to show status information such as battery life, camera mode, elapsed time, and the like. The image capture device 100 may also include a mode button 110 and a shutter button 112 that are configured to allow a user of the image capture device 100 to interact with the image capture device 100. For example, the mode button 110 and the shutter button 112 may be used to turn the image capture device 100 on and off, scroll through modes and settings, and select modes and change settings. The image capture device 100 may include additional buttons or interfaces (not shown) to support and/or control additional functionality.

The image capture device 100 may include a door 114 coupled to the body 102, for example, using a hinge mechanism 116. The door 114 may be secured to the body 102 using a latch mechanism 118 that releasably engages the body 102 at a position generally opposite the hinge mechanism 116. The door 114 may also include a seal 120 and a battery interface 122. When the door 114 is an open position, access is provided to an input-output (I/O) interface 124 for connecting to or communicating with external devices as described below and to a battery receptacle 126 for placement and replacement of a battery (not shown). The battery receptacle 126 includes operative connections (not shown) for power transfer between the battery and the image capture device 100. When the door 114 is in a closed position, the seal 120 engages a flange (not shown) or other interface to provide an environmental seal, and the battery interface 122 engages the battery to secure the battery in the battery receptacle 126. The door 114 can also have a removed position (not shown) where the entire door 114 is separated from the image capture device 100, that is, where both the hinge mechanism 116 and the latch mechanism 118 are decoupled from the body 102 to allow the door 114 to be removed from the image capture device 100.

The image capture device 100 may include a microphone 128 on a front surface and another microphone 130 on a side surface. The image capture device 100 may include other microphones on other surfaces (not shown). The microphones 128, 130 may be configured to receive and record audio signals in conjunction with recording video or separate from recording of video. The image capture device 100 may include a speaker 132 on a bottom surface of the image capture device 100. The image capture device 100 may include other speakers on other surfaces (not shown). The speaker 132 may be configured to play back recorded audio or emit sounds associated with notifications.

A front surface of the image capture device 100 may include a drainage channel 134. A bottom surface of the image capture device 100 may include an interconnect mechanism 136 for connecting the image capture device 100 to a handle grip or other securing device. In the example shown in FIG. 1B, the interconnect mechanism 136 includes folding protrusions configured to move between a nested or collapsed position as shown and an extended or open position (not shown) that facilitates coupling of the protrusions to mating protrusions of other devices such as handle grips, mounts, clips, or like devices.

The image capture device 100 may include an interactive display 138 that allows for interaction with the image capture device 100 while simultaneously displaying information on a surface of the image capture device 100.

The image capture device 100 of FIGS. 1A-B includes an exterior that encompasses and protects internal electronics. In the present example, the exterior includes six surfaces (i.e. a front face, a left face, a right face, a back face, a top face, and a bottom face) that form a rectangular cuboid. Furthermore, both the front and rear surfaces of the image capture device 100 are rectangular. In other embodiments, the exterior may have a different shape. The image capture device 100 may be made of a rigid material such as plastic, aluminum, steel, or fiberglass. The image capture device 100 may include features other than those described here. For example, the image capture device 100 may include additional buttons or different interface features, such as interchangeable lenses, cold shoes, and hot shoes that can add functional features to the image capture device 100.

The image capture device 100 may include various types of image sensors, such as charge-coupled device (CCD) sensors, active pixel sensors (APS), complementary metal-oxide-semiconductor (CMOS) sensors, N-type metal-oxide-semiconductor (NMOS) sensors, and/or any other image sensor or combination of image sensors.

Although not illustrated, in various embodiments, the image capture device 100 may include other additional electrical components (e.g., an image processor, camera system-on-chip (SoC), etc.), which may be included on one or more circuit boards within the body 102 of the image capture device 100.

The image capture device 100 may interface with or communicate with an external device, such as an external user interface device (not shown), via a wired or wireless computing communication link (e.g., the I/O interface 124). Any number of computing communication links may be used. The computing communication link may be a direct computing communication link or an indirect computing communication link, such as a link including another device or a network, such as the internet, may be used.

In some implementations, the computing communication link may be a Wi-Fi link, an infrared link, a Bluetooth (BT) link, a cellular link, a ZigBee link, a near field communications (NFC) link, such as an ISO/IEC 20643 protocol link, an Advanced Network Technology interoperability (ANT+) link, and/or any other wireless communications link or combination of links.

In some implementations, the computing communication link may be an HDMI link, a USB link, a digital video interface link, a display port interface link, such as a Video Electronics Standards Association (VESA) digital display interface link, an Ethernet link, a Thunderbolt link, and/or other wired computing communication link.

The image capture device 100 may transmit images, such as panoramic images, or portions thereof, to the external user interface device via the computing communication link, and the external user interface device may store, process, display, or a combination thereof the panoramic images.

The external user interface device may be a computing device, such as a smartphone, a tablet computer, a phablet, a smart watch, a portable computer, personal computing device, and/or another device or combination of devices configured to receive user input, communicate information with the image capture device 100 via the computing communication link, or receive user input and communicate information with the image capture device 100 via the computing communication link.

The external user interface device may display, or otherwise present, content, such as images or video, acquired by the image capture device 100. For example, a display of the external user interface device may be a viewport into the three-dimensional space represented by the panoramic images or video captured or created by the image capture device 100.

The external user interface device may communicate information, such as metadata, to the image capture device 100. For example, the external user interface device may send orientation information of the external user interface device with respect to a defined coordinate system to the image capture device 100, such that the image capture device 100 may determine an orientation of the external user interface device relative to the image capture device 100.

Based on the determined orientation, the image capture device 100 may identify a portion of the panoramic images or video captured by the image capture device 100 for the image capture device 100 to send to the external user interface device for presentation as the viewport. In some implementations, based on the determined orientation, the image capture device 100 may determine the location of the external user interface device and/or the dimensions for viewing of a portion of the panoramic images or video.

The external user interface device may implement or execute one or more applications to manage or control the image capture device 100. For example, the external user interface device may include an application for controlling camera configuration, video acquisition, video display, or any other configurable or controllable aspect of the image capture device 100.

The user interface device, such as via an application, may generate and share, such as via a cloud-based or social media service, one or more images, or short video clips, such as in response to user input. In some implementations, the external user interface device, such as via an application, may remotely control the image capture device 100 such as in response to user input.

The external user interface device, such as via an application, may display unprocessed or minimally processed images or video captured by the image capture device 100 contemporaneously with capturing the images or video by the image capture device 100, such as for shot framing or live preview, and which may be performed in response to user input. In some implementations, the external user interface device, such as via an application, may mark one or more key moments contemporaneously with capturing the images or video by the image capture device 100, such as with a tag or highlight in response to a user input or user gesture.

The external user interface device, such as via an application, may display or otherwise present marks or tags associated with images or video, such as in response to user input. For example, marks may be presented in a camera roll application for location review and/or playback of video highlights.

The external user interface device, such as via an application, may wirelessly control camera software, hardware, or both. For example, the external user interface device may include a web-based graphical interface accessible by a user for selecting a live or previously recorded video stream from the image capture device 100 for display on the external user interface device.

The external user interface device may receive information indicating a user setting, such as an image resolution setting (e.g., 3840 pixels by 2160 pixels), a frame rate setting (e.g., 60 frames per second (fps)), a location setting, and/or a context setting, which may indicate an activity, such as mountain biking, in response to user input, and may communicate the settings, or related information, to the image capture device 100.

Figure 3:
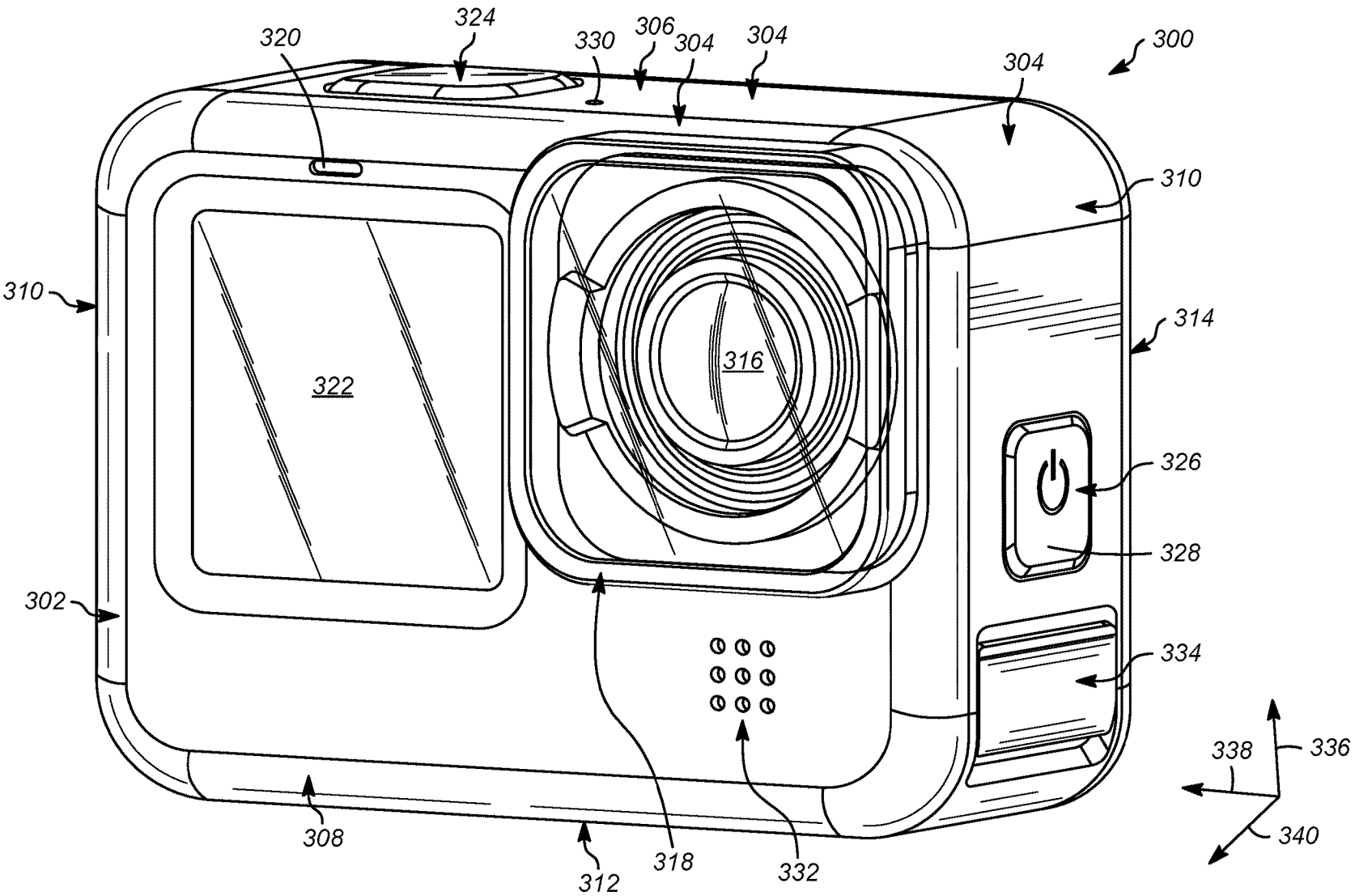
FIG. 3 is an isometric view of an alternate example of an image capture device.
Figure 4A:
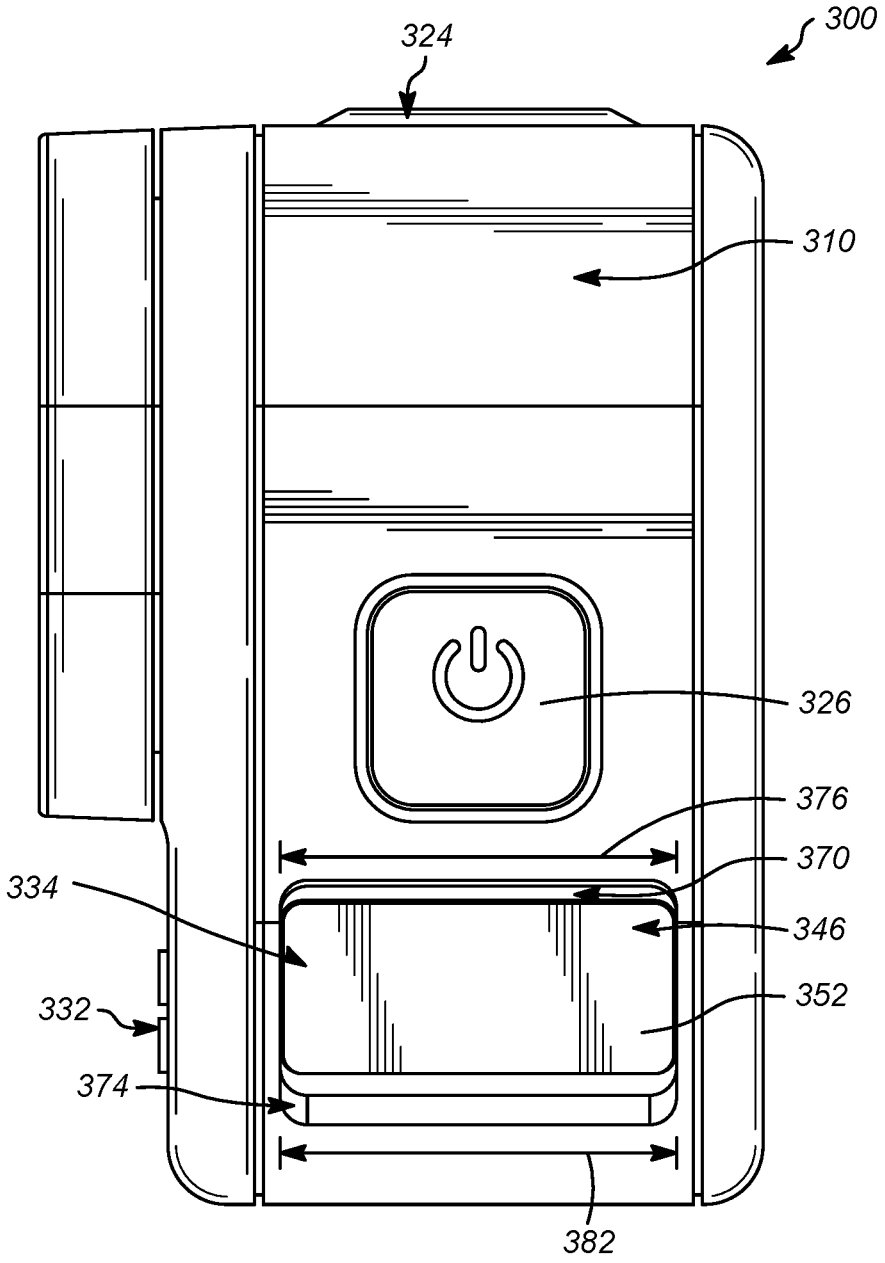
FIG. 4A is a side view of the image capture device shown in FIG. 3.
Figure 4B:
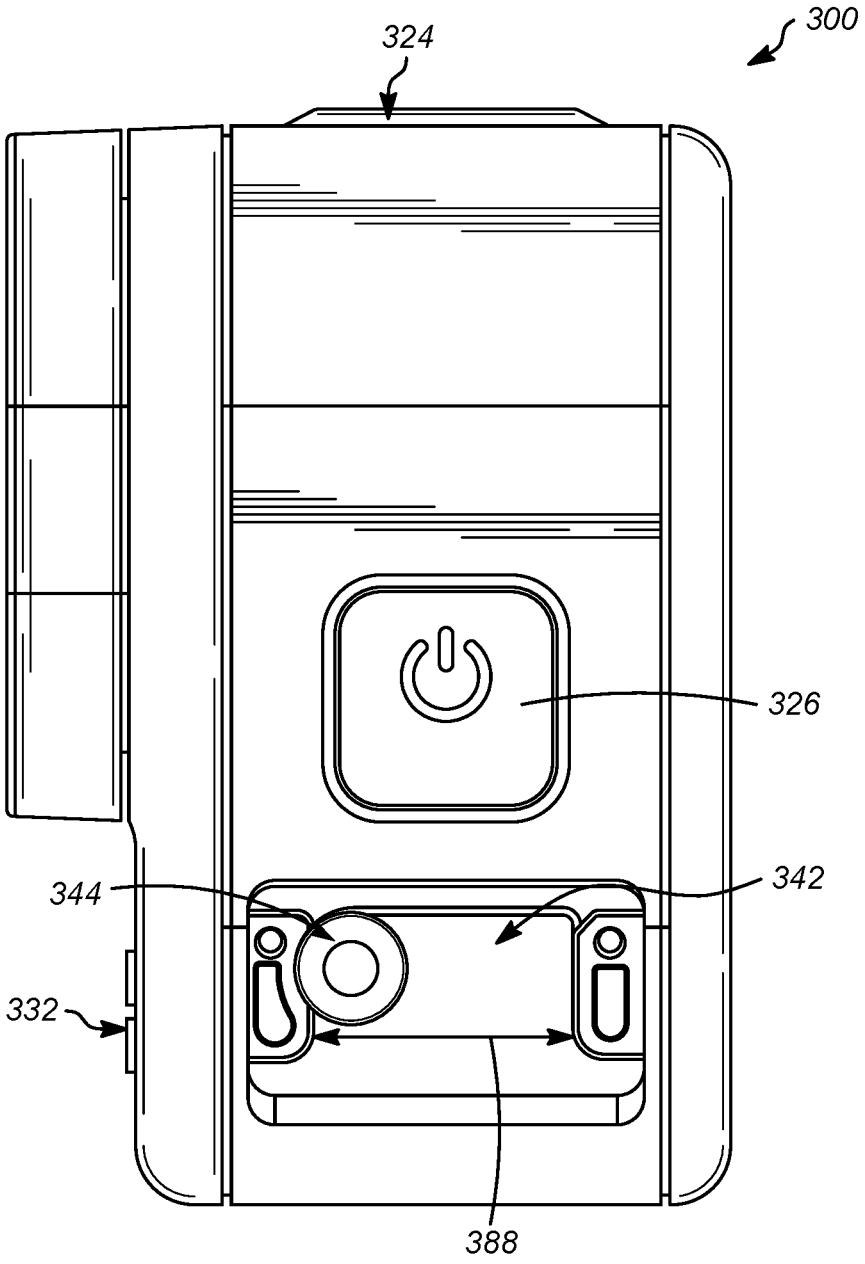
FIG. 4B is a side view of the image capture device shown in FIG. 3, the view showing the drainage microphone assembly without the cover.
Figure 5:
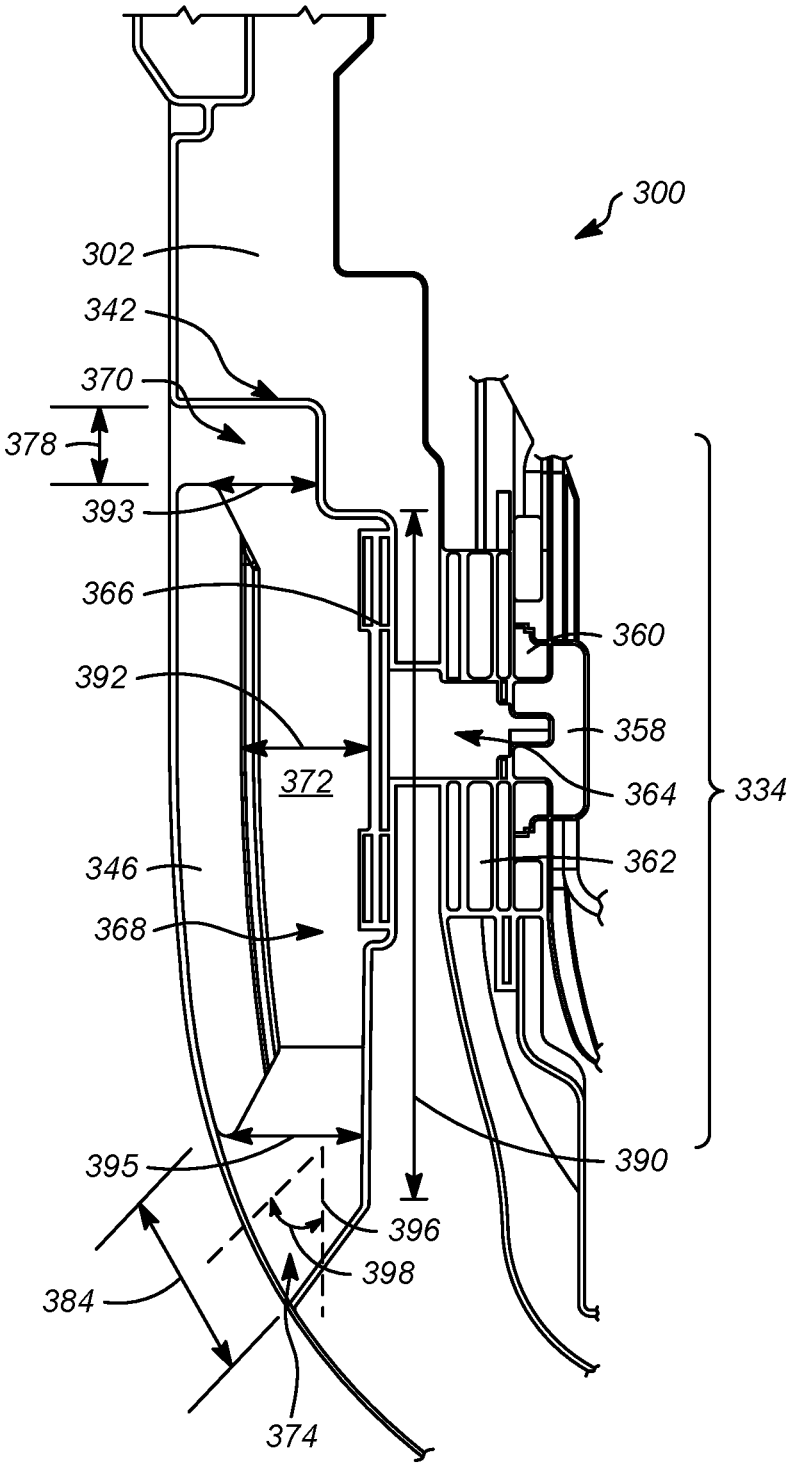
FIG. 5 is a cross-sectional view of the drainage microphone assembly shown in FIGS. 3 and 4A.

The image capture device 100 may be used to implement some or all of the techniques described in this disclosure, such as the technique for implementing a drainage microphone into advanced audio processing applications as described in FIGS. 3-5.

Figure 2:
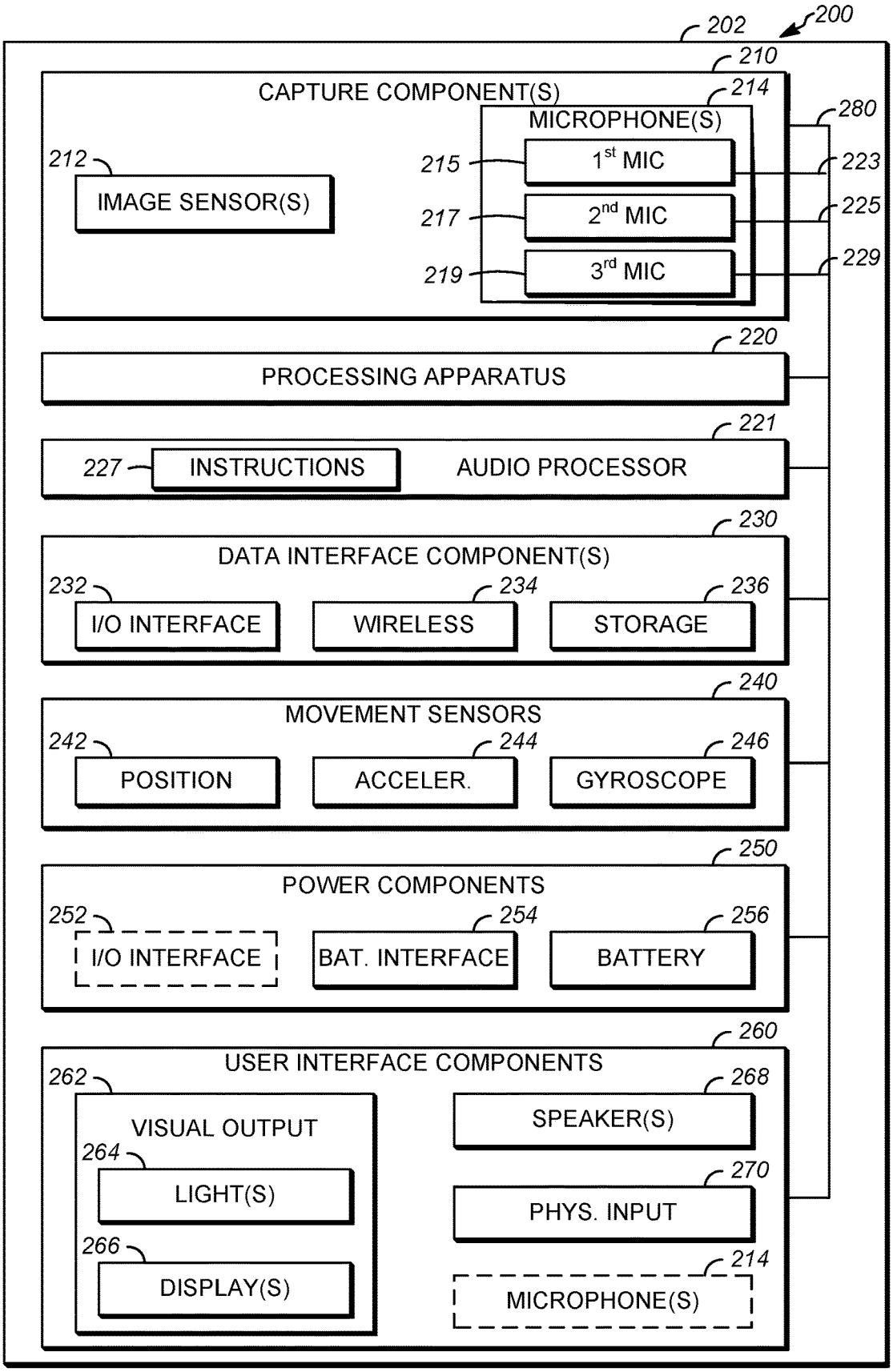
FIG. 2 is a block diagram of electronic components of an image capture device.

FIG. 2 is a block diagram of electronic components in an image capture device 200. The image capture device 200 may be a single-lens image capture device, a multi-lens image capture device, or variations thereof, including an image capture device with multiple capabilities such as use of interchangeable integrated sensor lens assemblies. The description of the image capture device 200 is also applicable to the image capture devices 100, 300 of FIGS. 1A-B and 3-7.

The image capture device 200 includes a body 202 which includes electronic components such as capture components 210, a processing apparatus (processor) 220, an audio processor 221, data interface components 230, movement sensors 240, power components 250, and/or user interface components 260.

The capture components 210 include one or more image sensors 212 for capturing images and one or more microphones 214 for capturing audio. In one example, the capture components 210, specifically, the microphones 214, include a first microphone 215, a second microphone 217, and a third microphone 219. The processing apparatus 220 is coupled with memory storing instructions 227 from which executable instructions may be obtained. The processing apparatus 220 is in communication with the audio processor 221. The audio processor 221 may be coupled to and/or include the first microphone 215, the second microphone 217 (such as a front microphone), and the third microphone 219. The audio processor 221 is configured to capture a first audio channel 223 from the first microphone 215, a second audio channel 225 from the second microphone 217, and a third audio channel 229 from the third microphone 219. The audio processor 221 outputs these audio channels 223/225/229 to the processor.

The image sensor(s) 212 is configured to detect light of a certain spectrum (e.g., the visible spectrum or the infrared spectrum) and convey information constituting an image as electrical signals (e.g., analog or digital signals). The image sensor(s) 212 detects light incident through a lens coupled or connected to the body 202. The image sensor(s) 212 may be any suitable type of image sensor, such as a charge-coupled device (CCD) sensor, active pixel sensor (APS), complementary metal-oxide-semiconductor (CMOS) sensor, N-type metal-oxide-semiconductor (NMOS) sensor, and/or any other image sensor or combination of image sensors. Image signals from the image sensor(s) 212 may be passed to other electronic components of the image capture device 200 via a bus 280, such as to the processing apparatus 220. In some implementations, the image sensor(s) 212 includes a digital-to-analog converter. A multi-lens variation of the image capture device 200 can include multiple image sensors 212.

The microphone(s) 214 is configured to detect sound, which may be recorded in conjunction with capturing images to form a video. The microphone(s) 214 may also detect sound in order to receive audible commands to control the image capture device 200.

The processing apparatus 220 may be configured to perform image signal processing (e.g., filtering, tone mapping, stitching, and/or encoding) to generate output images based on image data from the image sensor(s) 212. The processing apparatus 220 may include one or more processors having single or multiple processing cores. In some implementations, the processing apparatus 220 may include an application specific integrated circuit (ASIC). For example, the processing apparatus 220 may include a custom image signal processor. The processing apparatus 220 may exchange data (e.g., image data) with other components of the image capture device 200, such as the image sensor(s) 212, via the bus 280.

The processing apparatus 220 may include memory, such as a random-access memory (RAM) device, flash memory, or another suitable type of storage device, such as a non-transitory computer-readable memory. The memory of the processing apparatus 220 may include executable instructions and data that can be accessed by one or more processors of the processing apparatus 220 and are executed by the processing apparatus 220. For example, the processing apparatus 220 may include one or more dynamic random-access memory (DRAM) modules, such as double data rate synchronous dynamic random-access memory (DDR SDRAM). In some implementations, the processing apparatus 220 may include a digital signal processor (DSP). More than one processing apparatus may also be present or associated with the image capture device 200.

The data interface components 230 enable communication between the image capture device 200 and other electronic devices, such as a remote control, a smartphone, a tablet computer, a laptop computer, a desktop computer, or a storage device. For example, the data interface components 230 may be used to receive commands to operate the image capture device 200, transfer image data to other electronic devices, and/or transfer other signals or information to and from the image capture device 200. The data interface components 230 may be configured for wired and/or wireless communication. For example, the data interface components 230 may include an I/O interface 232 that provides wired communication for the image capture device, which may be a USB interface (e.g., USB type-C), a high-definition multimedia interface (HDMI), or a FireWire interface. The data interface components 230 may include a wireless data interface 234 that provides wireless communication for the image capture device 200, such as a Bluetooth interface, a ZigBee interface, and/or a Wi-Fi interface. The data interface components 230 may include a storage interface 236, such as a memory card slot configured to receive and operatively couple to a storage device (e.g., a memory card) for data transfer with the image capture device 200 (e.g., for storing captured images and/or recorded audio and video).

The movement sensors 240 may detect the position and movement of the image capture device 200. The movement sensors 240 may include a position sensor 242, an accelerometer 244, or a gyroscope 246. The position sensor 242, such as a global positioning system (GPS) sensor, is used to determine a position of the image capture device 200. The accelerometer 244, such as a three-axis accelerometer, measures linear motion (e.g., linear acceleration) of the image capture device 200. The gyroscope 246, such as a three-axis gyroscope, measures rotational motion (e.g., rate of rotation) of the image capture device 200. Other types of movement sensors 240 may also be present or associated with the image capture device 200.

The power components 250 may receive, store, and/or provide power for operating the image capture device 200. The power components 250 may include a battery interface 252 and a battery 254. The battery interface 252 operatively couples to the battery 254, for example, with conductive contacts to transfer power from the battery 254 to the other electronic components of the image capture device 200. The power components 250 may also include the I/O interface 232, as indicated in dotted line, and the power components 250 may receive power from an external source, such as a wall plug or external battery, for operating the image capture device 200 and/or charging the battery 254 of the image capture device 200.

The user interface components 260 may allow the user to interact with the image capture device 200, for example, providing outputs to the user and receiving inputs from the user. The user interface components 260 may include visual output components 262 to visually communicate information and/or present captured images to the user. The visual output components 262 may include one or more lights 264 and/or more displays 266. The display(s) 266 may be configured as a touch screen that receives inputs from the user. The user interface components 260 may also include one or more speakers 268. The speaker(s) 268 can function as an audio output component that audibly communicates information and/or presents recorded audio to the user. The user interface components 260 may also include one or more physical input interfaces 270 that are physically manipulated by the user to provide input to the image capture device 200. The physical input interfaces 270 may, for example, be configured as buttons, toggles, or switches. The user interface components 260 may also be considered to include the microphone(s) 214, as indicated in dotted line, and the microphone(s) 214 may function to receive audio inputs from the user, such as voice commands.

The image capture device 200 may be used to implement some or all of the techniques described in this disclosure, such as the technique for implementing a drainage microphone into advanced audio processing applications as described in FIGS. 3-5.

FIG. 3 illustrates another example of an image capture device 300 similar to the image capture device 100 described in detail in FIGS. 1A and 1B. The image capture device 300 includes a housing or body 302 defining a plurality of generally orthogonal surfaces 304. These orthogonal surfaces 304 may include a top housing surface 306, a front housing surface 308, two side housing surfaces 310, a bottom surface 312, and a rear surface 314. The image capture device 300 may further include at least one camera lens 316 disposed on a surface of the housing or body 302 and a transparent protective lens cover 318 mounted on the housing 302 to protect the camera lens 316 from environmental damage.

The image capture device 300 may include electronics (e.g., imaging electronics, power electronics, etc.) internal to the housing or body 302 for capturing images via the lens 316 and/or performing other functions. The image capture device may include various indicators such as an LED light 320 and may include an interactive display 322 that allows for interaction with the image capture device 100 while simultaneously displaying information on a surface of the image capture device 100. The image capture device 100 may include various input mechanisms such as buttons, switches, and touchscreen mechanisms. For example, the image capture device 300 may include buttons 324 configured to allow a user of the image capture device 300 to interact with the image capture device 300, to turn the image capture device 300 on, and to otherwise configure the operating mode of the image capture device 300. In an implementation, the image capture device 300 includes a power button and a mode button. It should be appreciated, however, that, in alternate embodiments, the image capture device 300 may include additional buttons to support and/or control additional functionality. The image capture device 300 may also include I/O ports 326 positioned behind a movable waterproof port cover 328. In another example, the image capture device 300 may include additional buttons or different interface features, such as interchangeable lenses, cold shoes, and hot shoes that can add functional features to the image capture device 300, etc. In some embodiments, the image capture device 300 described herein includes features other than those described.

The image capture device 300 may also include one or more microphones configured to receive and record audio signals (e.g., voice or other audio commands) in conjunction with recording video or in connection with audible control commands. In the example shown in FIG.3, three microphones are shown using representative patterns of apertures or depressions extending partially into or fully through the housing or body 302, though any number of microphones, such as one, two, four, or six may be used. The apertures or depressions may be a combination of design features formed as depressions in the housing or body 302 and apertures that extend fully through the housing or body 302. The patterns of apertures and depressions are designed to allow the microphones disposed within the housing or body 302 proximate to locations of the apertures and depressions (i.e., nearby) to capture ambient audio from an environment external to the housing or body 302 of the image capture device 300.

In an implementation, such as the example of FIG. 3, the microphones may include a top microphone 330 positioned below the top housing surface 306, a front microphone 332 positioned below the front housing surface 308, and a drainage arrangement 334 positioned on one of the side housing surfaces 310. Although the drainage arrangement 334 is depicted on a side housing surface 310, it is contemplated that it could be located on any suitable surface of the housing or body 302 that allows for gravity to support liquid trapped within it to drain when the image capture device 300 is moved from a liquid environment to a non-liquid environment. For reference purposes, the image capture device 300 may be referenced by a vertical axis 336 aligned in the direction between the top housing surface 306 and the bottom surface 312, a horizontal axis 338 aligned in the direction between the two side housing surfaces 310, and a fore/aft axis 340 aligned in the direction between the front housing surface 308 and back surface 314.

FIGS. 4A and 4B are side views of the image capture device 300 depicted in FIG. 3. The drainage arrangement 334 includes an audio depression 342 formed in the housing 302. The audio depression 342 is an indent in the side housing surface 310 of the housing 302. A drainage microphone 344 is coupled to the housing 302 within the audio depression 342 as shown in FIG. 4B. The drainage arrangement 334 includes a cover 346 coupled to the housing 302 at the location of the audio depression 342 as shown in FIG. 4A. The cover 346 may be formed of any suitable material and may be mounted to, molded onto, or formed on the housing 302 in any suitable manner.

FIG. 5 is a cross-sectional image of the image capture device 300 shown in FIG. 3 detailing the drainage microphone 344. In this example, the drainage microphone 344 includes at least one drainage microphone element 358 positioned internally to the housing 302. A compression gasket 360 and an acoustic sealing gasket 362 are positioned between the drainage microphone element 358 and the housing 302. A port 364 is formed in the housing to allow audio to pass through from the exterior of the housing 302 to the drainage microphone element 358. A waterproof membrane 366 is mounted onto an innermost surface of the audio depression 342 exterior to the port 364 to prevent liquid from directly contacting the drainage microphone element 358.

The cover 346, when mounted to the audio depression 342, defines a drainage channel 368 through which liquids can flow. The drainage channel 368 can fill with liquid when the image capture device 300 is submerged during operation. When the image capture device 300 is removed from the liquid environment, the drainage channel 368 utilizes gravity to drain moisture from the drainage microphone 344 and allow the moisture to exit from the housing 302. The drainage channel 368 includes a channel entrance 370, a channel volume 372, and a channel exit 374. The channel entrance 370 is defined by a channel entrance width 376 (see FIG. 4A) and a channel entrance height 378. The surface area of the channel entrance 370 may be defined by the channel entrance width 376 multiplied by the channel entrance height 378 in the example illustrated in the described example. In other examples, however, the surface area of the opening of the channel entrance 370 may be defined simply as the planar surface area of the channel entrance 370. It is contemplated that the channel entrance 370 may, in other examples, have more complex geometric shapes as opposed to the generally rectangular opening illustrated in FIGS. 3-6.

The drainage channel 368 may further include a channel exit 374. The channel exit may be defined by a channel exit width 382 (see FIG. 4A) and a channel exit height 384. The surface area of the channel exit 374 may be defined by the channel exit width 382 multiplied by the channel exit height 384. In other examples, however, the surface area of the channel exit 374 may be defined simply as the planar surface area of the channel exit 374. It is contemplated that the channel exit 374 may be formed with more complex geometric shapes as opposed to the generally rectangular opening illustrated in FIGS. 3-6.

The drainage channel 368 forms a channel volume 372. The channel volume 372 may be generally defined by a channel volume width 388 (see FIG. 4B), a channel volume height 390, and a channel volume depth 392. A rough estimate of the channel volume 372 size may be obtained by multiplying the channel volume width 388 by the channel volume height 390 by the channel volume depth 392. It should be understood that a precise measuring of the channel volume 372 may be obtained through a variety of known measurements and/or calculations. It is contemplated that in some examples, the channel volume depth 392 need not be uniform but may vary from an upper channel volume depth 393 to a lower channel volume depth 395. In such cases, the channel volume 372 may be defined by the average volume depth or may be accurately calculated based on the varying depth throughout the channel volume height 390.

One challenge with known drainage microphone configurations is the production of resonance through drainage channels towards the internal microphone. In one example, the present disclosure contemplates the selection of a desired frequency range of audio signals for which resonance through a drainage channel can be reduced or eliminated. When the resonance for a desired frequency range of audio signals is reduced or eliminated in a drainage design, the design and structure of forming the drainage channel can be considered acoustically transparent. The present disclosure determined that the frequency range of resonance is directly related to the ratio of the surface area of the entrance or exit of the drainage channel to the volume of the drainage channel. In one example, the desired range of audio frequencies for which acoustic transparency is desired is 500 Hz to 9 kHz. This allows the audio captured by the drainage microphone 344 to be utilized in advanced audio processing functions such as beamforming.

In one example, the ratio of the surface area of the channel entrance 370 to the channel volume 372 is greater than 10% to provide the reduction of resonance within the 500 Hz to 9 kHz frequency range. In another example, the ratio of the surface area of the channel entrance 370 to the channel volume 372 is approximately 11%.

Similarly, in one example, the ratio of the surface area of the channel exit 374 to the channel volume 372 is greater than 10% to provide the reduction of resonance in the desired frequency range. In another example, the ratio of the surface area of the channel exit 374 to the channel volume 372 is greater than 20%. In still another example, the ratio of the surface area of the channel exit 374 to the channel volume 372 is approximately 25%.

In one example, the channel entrance 370 and the channel exit 374 are located on the same orthogonal surface 304 of the housing 302. The channel entrance 370 may be formed perpendicular to the vertical centerline 396 of the channel volume 372. The channel exit 374 may be formed at an angle 398 relative to the vertical centerline 396 of the channel volume 372 to facilitate drainage and to further reduce resonance in the desired frequency range.

The drainage microphone element 358 may be positioned on the side housing surface 310 within the audio depression 342 such that it is biased towards the front housing surface 308 of the housing/body 302. In this example, the drainage microphone element 358 is positioned closer to the front housing surface 308 relative to the vertical centerline 396. This allows the drainage microphone element 358 to be positioned relative to the front microphone 332 such that they are positioned less than 30 degrees from each other relative to the horizontal axis 338. The close proximity, small horizontal deviation, and the acoustic transparency of the drainage microphone 344 allow the described drainage arrangement 334 to be utilized in sophisticated audio processing procedures such as beamforming to output a stereo audio stream.

Figure 6A:
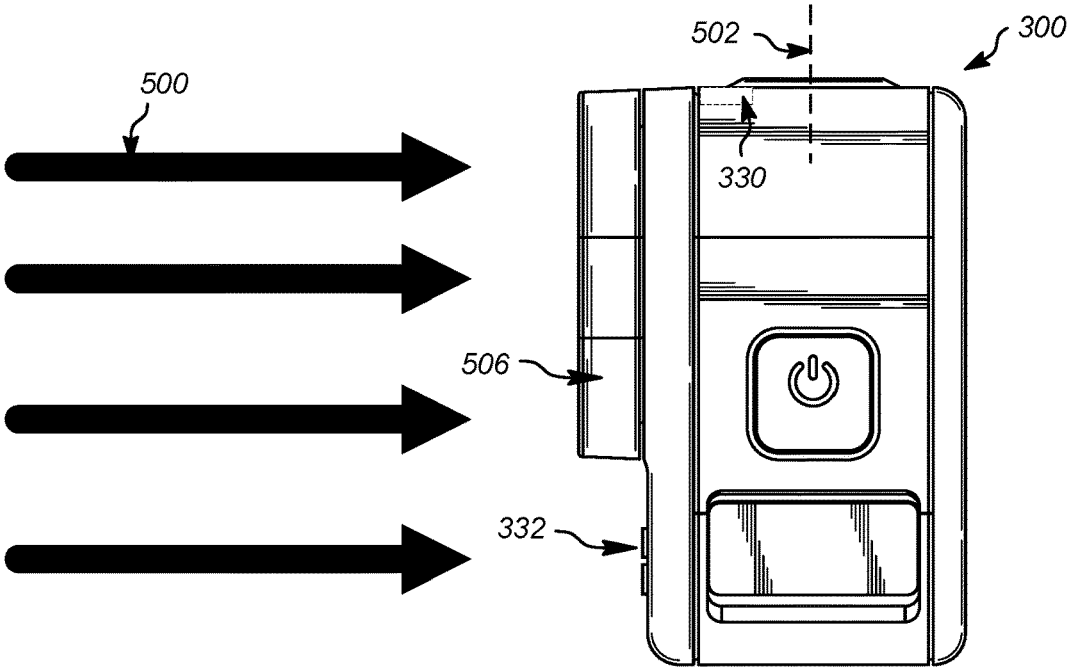
FIG. 6A is a side view of the image capture device shown in FIG. 3, the image capture device shown in a vertical orientation.

FIG. 6A is a side view of the image capture device 300 described in FIGS. 3-5. The image capture device 300 is depicted in an operational environment while in a vertical orientation 502. The image capture device 300 is depicted as exposed to freestream air flow 500. The freestream air flow 500 may be a product of the operating environment of the image capture device 300, it may be a product of forward motion of the image capture device 300, or a combination of both. While the image capture device 300 is in the vertical orientation, the freestream air flow 500 directly flows into the front microphone 332. The top microphone 330, however, does not receive direct freestream air flow 500 while the image capture device 300 is in a vertical orientation 502. In an embodiment depicted in FIG. 6B, the image capture device 300 is orientated in a pitched forward orientation 504. This may be a desirable orientation for many active mounting positions as it allows the image capture device 300 to capture video of forward motion, a framed shot of a user, and/or a mode of transportation. In this orientation, a bicycle wheel, a snowboard, a boat, the user, etc. may be partially captured along with the forward captured video. In the pitched forward orientation 504, however, any protruding elements 506 (such as the lens snout) may disrupt the direct freestream air flow 500 resulting in pockets of turbulent air flow 508. Turbulent air flow 508 may generate noise within the audio capture components of the image capture device 300. In one embodiment, the top microphone 330, the front microphone 332, and the drainage arrangement 334 are strategically arranged to accommodate the presence of turbulent air flow 508 while maintaining clear audio capture.

Figure 6B:
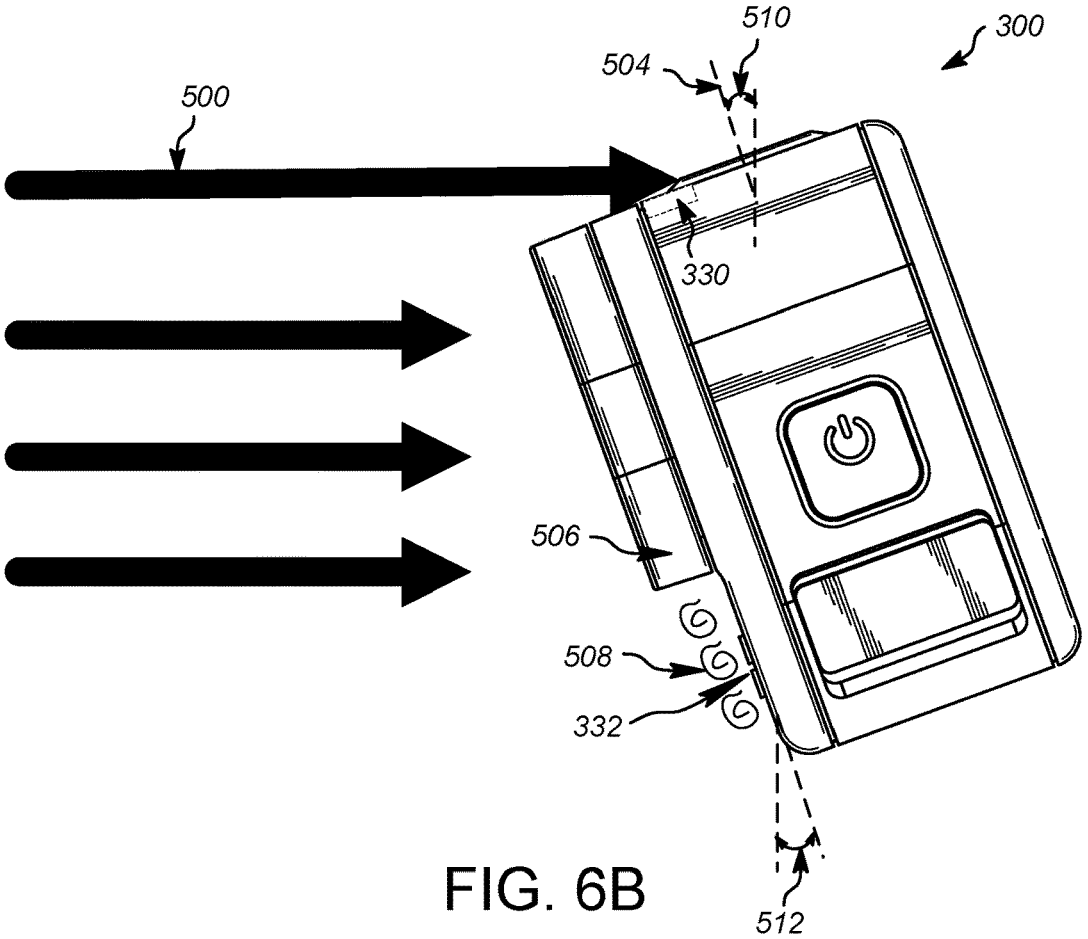
FIG. 6B is a side view of the image capture device shown in FIG. 3, the image capture device shown in a pitched forward orientation.

In FIG. 6B, the top microphone 330 is positioned on the top housing surface 306 of the image capture device 300 above the front housing surface 308. In one embodiment, the top microphone 330 is positioned on the top housing surface 306 in a position biased towards the front housing surface 308. The top microphone 330 is positioned in a front biased position so that when the image capture device 300 is positioned in the pitched forward orientation 504 at a first pitched forward angle 510, the top microphone 330 begins receiving direct freestream air flow 500. As the pitched forward orientation increases from the first pitched forward angle 510, larger portions the top microphone 330 become exposed to the direct freestream air flow 500 and an increasingly larger number of captured sub-band audio frequencies have a reduced noise metric.

The front microphone 332 is positioned below the lens snout (protruding element) 506. When the image capture device 300 is positioned in the pitched forward orientation 504 at a second pitched forward angle 512, the front microphone 332 begins being exposed to the turbulent air flow 508. As the pitched forward orientation increases from the second pitched forward angle 512, larger portions of the front microphone 332 become exposed to the turbulent air flow 508 and an increasingly larger number of captured sub-band audio frequencies have an increased noise metric. The top microphone 330 and the front microphone 332 are positioned such that as the sub-band audio frequencies captured by the front microphone 332 begin increasing in noise metric, the sub-band audio frequencies captured by the top microphone 330 begin decreasing in noise metric. In one embodiment, the second pitched forward angle 512 is equal to the first pitched forward angle 510 so that the decrease in noise metric from audio captured by the top microphone 330 acts simultaneously with the increase in noise metric from the audio captured by the front microphone 332. In another embodiment, the second pitched forward angle 512 is greater than the first pitched forward angle 510 so that the decrease in noise metric from the audio captured by the top microphone 330 begins prior to the increase in noise metric from the audio capture by the front microphone 332.

Although the prior embodiment has been described in terms of a first microphone (top microphone) 330 positioned below a first housing surface (top housing surface) 306 and a second microphone (front microphone) 332 positioned below a protruding element 506 on a second housing surface (front housing surface) 308, the disclosure is applicable to any combination of surfaces in any pitched orientation. The disclosure contemplates the combination of any first microphone 330 receiving direct freestream air flow 500 before or simultaneously with any second microphone 332 experiencing turbulent air flow 508 generated by any protruding element 506. This allows the processor 220 of FIG. 2 to minimize wind noise as described below.

Figure 7:
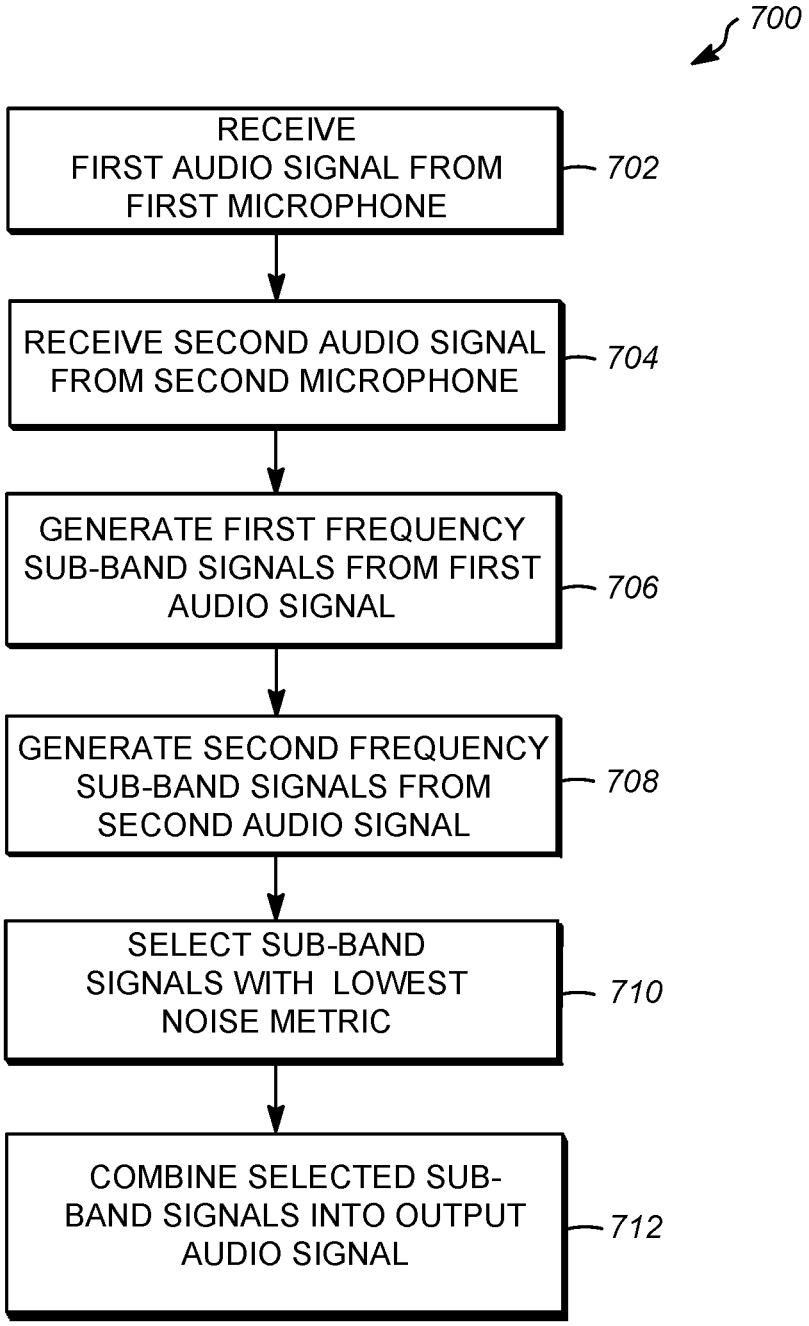
FIG. 7 is a flow chart illustrating the processing steps of the processor illustrated in FIG. 2.

FIG. 7 is a flowchart of an exemplary set of executable instructions 700 for use by the processor 220 of FIG. 2. The steps or executable instructions 700 include receiving a first audio signal from a first microphone 702. A second audio signal is received from a second microphone 704. For frequency sub-bands, the processor 220 generates first frequency sub-bands from the first audio signal 706. The processor 220 further generates second frequency sub-bands from the second audio signal 708. In one embodiment, the frequency sub-bands comprise 200 Hz frequency sub-bands in the frequency range of 500 Hz to 9 kHz. In another embodiment, the frequency sub-bands comprise 100 Hz frequency sub-bands in the frequency range of 500 Hz to 9 kHz. The processor 220 then, for the respective frequency sub-bands, selects one of the first frequency sub-band signals or the second frequency sub-band signals having the lowest noise metric 710. In one embodiment, the lowest noise metric comprises the sub-band signals having the lowest signal-to-noise ratio. In another embodiment, the lowest noise metric comprises the sub-band signals having the lowest resonance. The processor 220 then combines the selected sub-band signals to generate an output audio signal 712. In this manner, the method reduces wind noise in the generated output audio signal.

Figure 8:
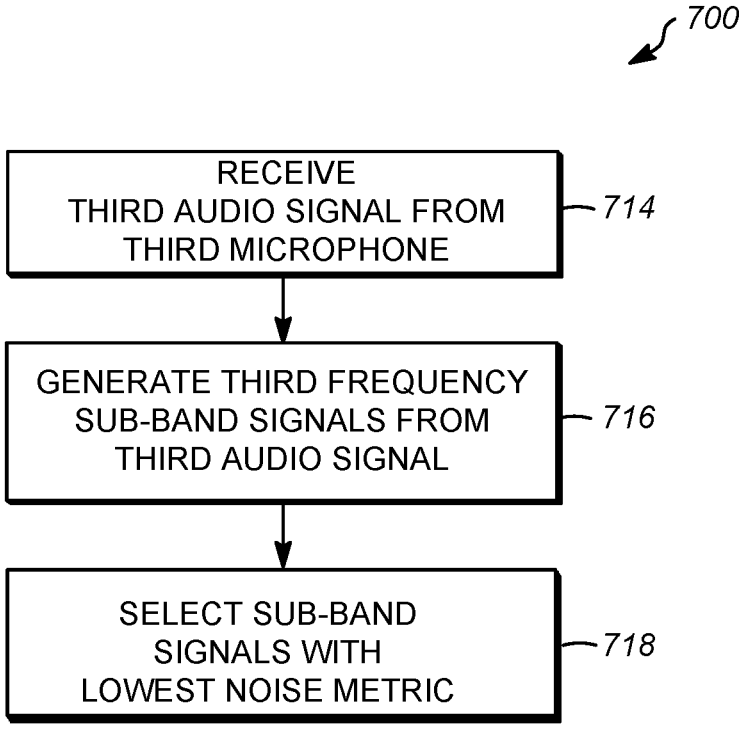
FIG. 8 is a flow chart illustrating additional processing steps of the processor illustrated in FIG. 2.

In another embodiment illustrated in FIG. 8, the executable instructions 700 further include receiving a third audio signal from a third microphone 714. For the frequency sub-bands, the processor 220 generates third frequency sub-band signals from the third audio signal 716. The processor 220, for the respective frequency sub-bands, selects one of the first frequency sub-band signals, the second frequency sub-band signals, or the third frequency sub-band signals having the lowest noise metric 718. In this embodiment, the processor may utilize additional microphones to accommodate a variety of pitched orientations and accommodate multiple surface features that may induce turbulent air flow 508.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. An image capture device, comprising:

a housing having a top housing surface and a front housing surface;

a lens snout protruding from the front housing surface;

a front microphone mounted within or on the front housing surface and below the lens snout;

a top microphone mounted within or on a top housing surface in a position biased toward the front housing surface;

a third microphone comprising a channel with a channel volume depth that is not uniform and varies from an upper channel volume depth to a lower channel volume depth; and an audio processor comprising a memory that is configured to store instructions that when executed cause the audio processor to generate an output audio signal, wherein the top microphone is located at a position to receive direct freestream air flow when the housing is positioned in a pitched forward orientation at a pitched forward angle relative to a vertical axis, and wherein the front microphone receives turbulent air flow from the lens snout when the housing is positioned in the pitched forward orientation.

2. The image capture device of claim 1, wherein the top microphone is located within the housing under the top housing surface.

3. The image capture device of claim 1, wherein the audio processor is configured to execute the instructions stored in the memory to:

receive a first audio signal from the front microphone;

for frequency sub-bands, generate first frequency sub-band signals from the first audio signal;

receive a second audio signal from the top microphone;

for the frequency sub-bands, generate second frequency sub-band signals from the second audio signal;

for the respective frequency sub-bands, select one of the first frequency sub-band signals or the second frequency sub-band signals having the lowest noise metric; and combine the selected sub-band signals to generate the output audio signal.

4. The image capture device of claim 1, further comprising a drainage microphone, wherein the drainage microphone includes a channel entrance surface area to channel volume ratio that moves audio wave resonance outside of a 500 Hz to 9 kHz frequency range.

5. The image capture device of claim 2, wherein the memory stores instructions that when executed cause the audio processor to:

perform beamforming on the first frequency sub-band signals and the second frequency sub-band signals to output a stereo audio stream.

6. The image capture device of claim 1, wherein the lens snout is of a sufficient length such that the lens snout, when in the pitched forward angle relative to the vertical axis, disrupts a direction of the freestream air flow creating turbulent air flow.

7. An image capture device, comprising:

a housing having a first housing surface and a second housing surface orthogonal to the first housing surface;

a protruding feature protruding from the first housing surface;

a first microphone mounted within or on the first housing surface and adjacent to the protruding feature;

a second microphone mounted within or on the second housing surface;

a third microphone comprising a channel with a channel volume depth that is not uniform and varies from an upper channel volume depth to a lower channel volume depth; and an audio processor comprising a memory configured to store instructions that when executed cause the audio processor to:

generate an output audio signal, wherein the first microphone receives direct freestream air flow when the housing is positioned in a pitched orientation with a first pitched angle;

wherein the first microphone does not receive direct freestream air flow while the housing is positioned in a vertical orientation with a second pitched angle, wherein the first pitched angle is greater than the second pitched angle relative to a vertical axis; and wherein turbulent air flow from the protruding feature contacts the second microphone when the housing is positioned in the pitched orientation.

8. The image capture device of claim 7, wherein the first pitched angle orients the housing in a pitched forward manner so that the housing is rotated away from the vertical orientation.

9. The image capture device of claim 7, wherein the second microphone is positioned below the protruding feature.

10. The image capture device of claim 7, wherein the first microphone is biased within the housing under the first housing surface towards the second housing surface.

11. The image capture device of claim 7, wherein the memory stores instructions that when executed cause the audio processor to:

receive a third audio signal from the third microphone;

for the frequency sub-bands, generate third frequency sub-band signals from the third audio signal;

for the respective frequency sub-bands, select one of the first frequency sub-band signals, the second frequency sub-band signals, or the third frequency sub-band signals having the lowest noise metric; and combine the selected sub-band signals to generate the output audio signal.

12. The image capture device of claim 7, wherein the memory stores instructions that when executed cause the audio processor to perform beamforming on the first frequency sub-band signals and a third frequency sub-band signals to output a stereo audio stream.

13. The image capture device of claim 7, wherein the lens snout extends outward into the direct freestream air flow such that the lens snout, when the housing is in the pitched orientation, disrupts a direction of the freestream air flow creating turbulent air flow.

14. A method comprising:

receiving, by an audio processor, a first audio signal from a first microphone mounted above a protruding feature extending from a first housing surface of a housing of an image capture device, the first microphone mounted to receive direct freestream air flow when the housing is positioned in a pitched forward orientation at a pitched forward angle relative to vertical;

receiving, by the audio processor, a second audio signal from a second microphone mounted below the protruding feature, wherein the second microphone receives turbulent air flow when the housing is positioned in the pitched forward orientation;

generating, by the audio processor, first frequency sub-band signals from the first audio signal;

generating, by the audio processor, second frequency sub-band signals from the second audio signal;

selecting, by the audio processor, one of the first frequency sub-band signals or the second frequency sub-band signals having a lowest noise metric as selected sub-band signals; and combining, by the audio processor, the selected sub-band signals to generate an output audio signal;

wherein the housing further comprises:

a third microphone comprising a channel with a channel volume depth that is not uniform and varies from an upper channel volume depth to a lower channel volume depth.

15. The method of claim 14, wherein the first microphone and the second microphone are positioned on separate orthogonal surfaces of the housing.

16. The method of claim 14, wherein the second microphone is positioned on the same surface of the housing as the protruding feature.

17. The method of claim 14, wherein the audio processor comprises memory and the method further comprises a step of storing instructions in the memory that when executed cause the audio processor to:

perform beamforming on the first frequency sub-band signals and the second frequency sub-band signals to output a stereo audio stream.

18. The method of claim 14, wherein the lowest noise metric is a lowest signal-to-noise ratio.

19. The image capture device of claim 1, wherein the third microphone is biased towards the front housing surface.

20. The image capture device of claim 7, wherein the third microphone is located on or within a side housing surface.

* * * * *